United States Patent [19]

Schluep et al.

[11] 4,088,171

[45] May 9, 1978

[54] VENETIAN BLIND

[75] Inventors: René Schluep, Unterentfelden; Josef Koch, Niedererlinsbach, both of Switzerland

[73] Assignee: Storen- und Maschinenfabrik Emil Schenker AG, Schonenwerd, Switzerland

[21] Appl. No.: 727,410

[22] Filed: Sep. 29, 1976

[30] Foreign Application Priority Data

Apr. 30, 1976 Switzerland ..... 005439/76

[51] Int. Cl.[2] ..... E06B 9/30

[52] U.S. Cl. ..... 160/170

[58] Field of Search ..... 160/170, 171

[56] References Cited

U.S. PATENT DOCUMENTS 2,732,010 1/1956 Griesser ..... 160/170

3,260,302 7/1966 Griesser ..... 160/170

*Primary Examiner*—Peter M. Caun

*Attorney, Agent, or Firm*—Peter K. Kontler

[57] ABSTRACT

A venetian blind wherein the slats are moved up and down by means of cords or strips in response to rotation of a shaft in clockwise and anticlockwise directions. The shaft actuates a mechanism serving to turn the slats between open and closed positions and through intermediate positions in which the slats are partly open. The mechanism is caused to automatically maintain the slats in the open positions during upward movement of slats and in the intermediate positions when the slats move downwardly. The slats can turn between the open and closed positions when the venetian blind is fully extended. Yieldable detents are provided to releasably hold the slats in the open, closed or intermediate positions.

13 Claims, 8 Drawing Figures

VENETIAN BLIND

BACKGROUND OF THE INVENTION

The present invention relates to improvements in venetian blinds in general, and more particularly to improvements in venetian blinds of the type having horizontal slats and means for turning the slats between open and closed positions. Still more particularly, the invention relates to improvements in venetian blinds wherein the means for turning the slats has parts which are mounted at a level above the uppermost slat and are designed to move the slats to open positions in response to shortening of the blind.

In presently known venetian blinds of the just outlined character, the slats assume open or nearly open positions (in which each slat is located in a substantially horizontal plane) in automatic response to raising of the slats, and the slats assume closed or practically closed positions in automatic response to lowering of the slats. Such venetian blinds exhibit the advantage that the slats allow more light to pass through the blind during raising, i.e., at a time when the occupant of the room normally desires to admit more light (e.g., in the evening when the admission of additional light is desirable in view of the progressing darkness at the outside). However, the movement of slats to closed positions in automatic response to lengthening of the venetian blind constitutes a drawback, at least in many instances, because a complete lowering of slats invariably entails a complete or substantial darkening of the room. For example, a housewife is likely to cause all venetian blinds in a room to assume their fully or partly extended positions when the windows are closed; however, such extension of all blinds is not intended to prevent entry of daylight but merely to enhance the appearance of the room.

SUMMARY OF THE INVENTION

An object of the invention is to provide a novel and improved venetian blind wherein the slats are turnable between open and closed positions when the blind is fully extended.

Another object of the invention is to provide a venetian blind wherein the slats need not assume their closed positions during movement toward the lower end positions in which the venetian blind is fully extended.

A further object of the invention is to provide a venetian blind wherein each of the slats assumes an optimum angular position during lengthening or shortening of the blind.

An additional object of the invention is to provide the venetian blind with novel and improved turning means for changing the angular positions of slats and with novel and improved means for controlling the operation of such turning means.

Another object of the invention is to provide a venetian blind wherein the slats are at least partially open during lengthening or shortening of the blind.

An ancillary object of the invention is to provide novel and improved means for changing the length of the blind and novel and improved means for connecting the length changing means with the aforementioned turning means.

The improved venetian blind comprises a plurality of substantially horizontal parallel slats disposed one above the other (the slats may consist of a metallic, synthetic plastic or other material and may but need not be flexible), means for moving the slats upwardly and downwardly between upper and lower end positions in which the blind is respectively fully contracted and fully extended, means for turning the slats between first and second end positions in which the slats are respectively open and closed, means for maintaining the slats at least close to the first end positions (open positions) while the moving means (which preferably comprises a rotary shaft mounted above the uppermost slat) is operated to move the slats upwardly, and means for maintaining the slats in predetermined intermediate (partly open) positions, i.e., between the first and second end positions, while the moving means is operated to move the slats downwardly.

The ventian blind preferably further comprises detent means for releasably holding the slats in the first end positions, in the second end positions and/or in the intermediate positions.

The means for maintaining the slats in intermediate positions during lengthening of the venetian blind preferably comprises arresting means which is movable between operative and inoperative positions in which the arresting means respectively maintains the slats in the intermediate positions and allows the turning means to turn the slats between first and second end positions, means for moving the arresting means to operative position in response to operation of the means for moving the slats upwardly and downwardly in a direction to move the slats upwardly, and means for moving the arresting means to inoperative position not later than when the slats reach the lower end positions so that the slats are turnable, at least to the second end positions, when the venetian blind is fully extended.

The novel features which are considered as characteristic of the invention are set forth in particular in the appended claims. The improved venetian blind itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
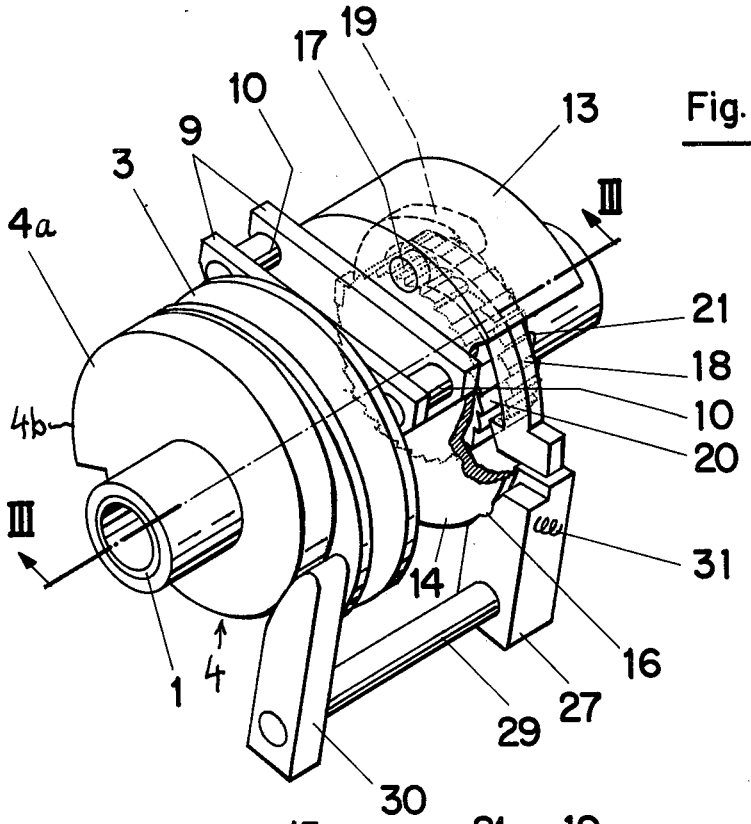
FIG. 1 is a fragmentary perspective view of a portion of a venetian blind which embodies one form of the invention, the arresting means of the means for maintaining the slats in intermediate positions being shown in the operative position.
Figure 2:
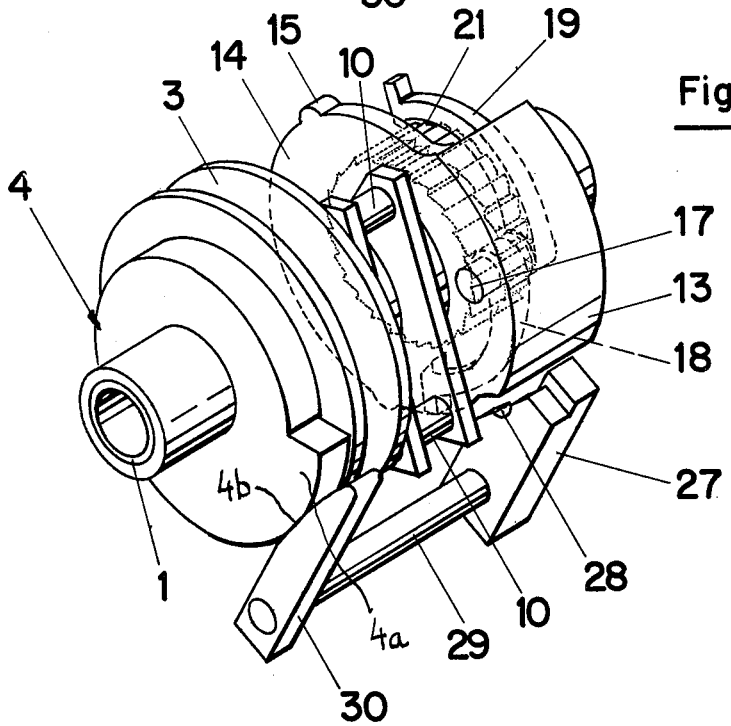
FIG. 2 illustrates the structure of FIG. 1 but with the arresting means in the inoperative position.
Figure 3:
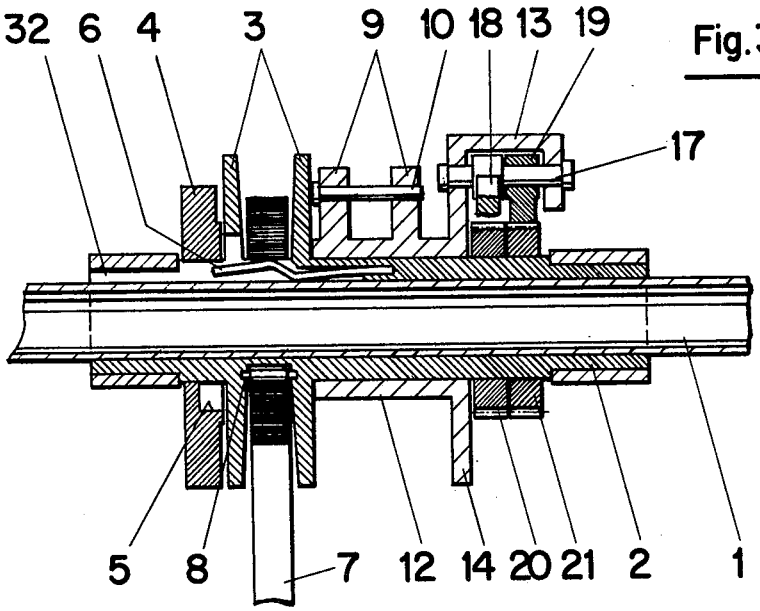
FIG. 3 is a vertical sectional view as seen in the direction of arrows from the line III—III of FIG. 1, the means for moving the slats up and down being shown in a position its parts assume when the length of the venetian blind is less than the maximum length.
Figure 4:
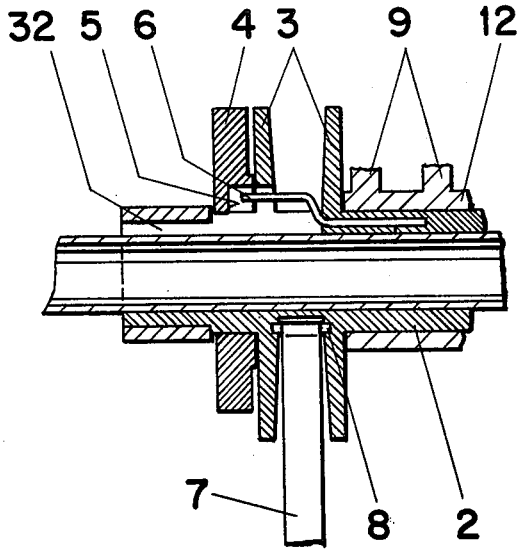
FIG. 4 illustrates a portion of the structure shown in FIG. 1, with the parts of means for moving the slats up and down in positions they assume when the venetian blind is fully extended.

Referring first to FIGS. 1 to 7, there is shown a portion of a venetian blind which comprises a horizontal shaft 1 constituting a means for supporting nearly all components of the blind, including a row of horizontal slats 25 (FIGS. 5 to 7) and mechanisms which can be operated to raise or lower the slats as well as to change the angular positions of the slats. The end portions of the shaft 1 are rotatable in customary brackets (not shown) which are mounted on a wall in front of and at the two upper corners of a window. The shaft 1 is rigid with a sleeve 2 having two parallel disks 3 which constitute the flanges of a pulley. A disk-shaped cam 4 having a tooth-shaped lobe 4*a* is rotatable on the sleeve 2 adjacent to one of the flanges 3. The internal surface of the cam 4 has a recess or notch 5 which can receive the free end portion of a coupling spring 6 the other end portion of which is anchored in the sleeve 2. The free end portion of the spring 6 tends to move radially of and away from the sleeve 2 and to enter the recess 5 of the cam 4 in a predetermined angular position of the parts 2 and 4 with respect to each other. The major part of the spring 6 is located in a longitudinally extending groove 32 which is machined into the internal surface of the sleeve 2. The means for expelling the free end portion of the spring 6 from the recess 5 comprises a cord, strip or an analogous flexible member 7 one end of which is affixed to the sleeve 2 between the flanges 3 and the other end of which is affixed to the lowermost slat 25 (or to a customary rail, not shown, which is located below or replaces the lowermost slat). The length of the flexible element 7 (hereinafter called strip) is such that the ventian blind is fully extended when the strip is unwound from the pulley including the flanges 3 and the portion of the sleeve 2 between such flanges. As soon as the shaft 1 is rotated in a direction to convolute the strip 7 onto the sleeve 2 between the flanges 3, the convoluted strip depresses the spring 6 and expels its free end portion from the recess 5 of the cam 4. Thus, the cam 4 is coupled with the sleeve 2 and shaft 1 only when the strip 7 is unwound from the pulley. The means for securing the upper end of the strip 7 to the pulley includes a pin 8 (see FIGS. 3 and 4) which is parallel to the axis of the shaft 1 and is journalled in the inner surfaces of the flanges 3. The means for rotating the sleeve 2 through the medium of the shaft 1 is not shown in the drawing; such means may include a customary pulley and a cord which can be pulled in one direction to rotate the shaft 1 clockwise or in the opposite direction to rotate the shaft counterclockwise.

Figure 7:
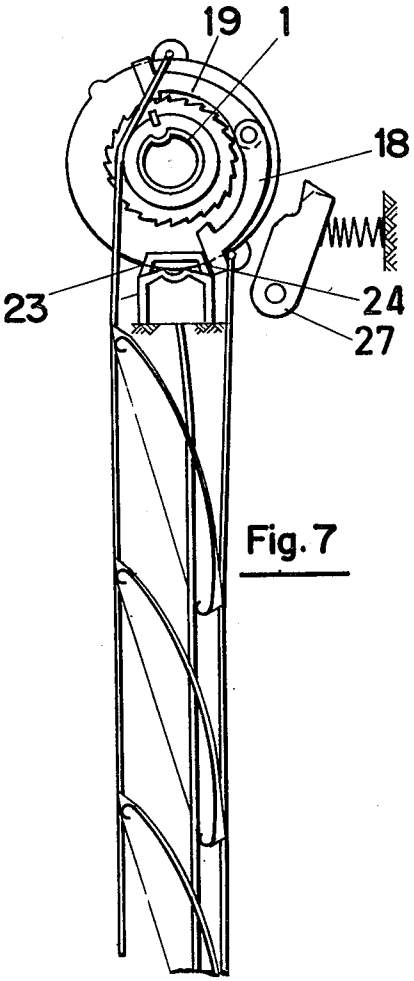
FIG. 7 is a similar end elevational view, with the slats shown in closed positions.
Figure 6:
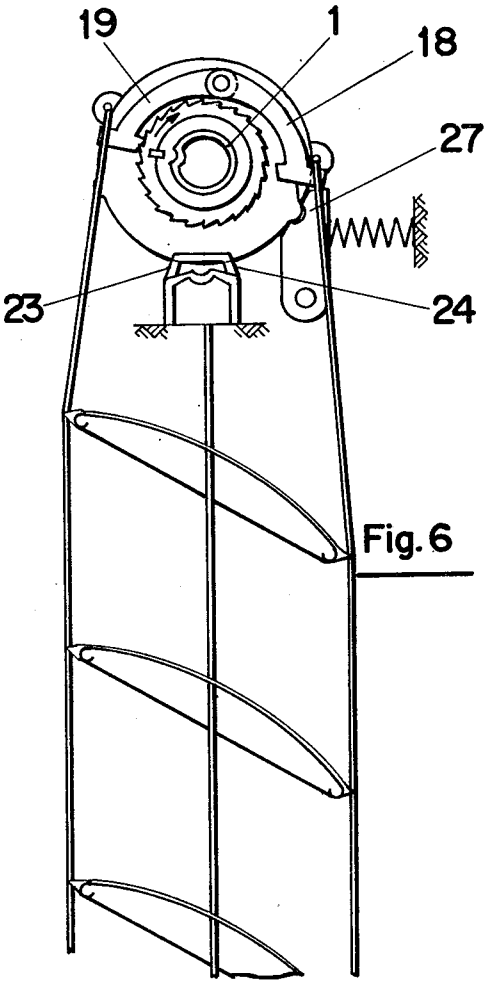
FIG. 6 is a similar end elevational view, with the slats shown in intermediate positions.
Figure 5:
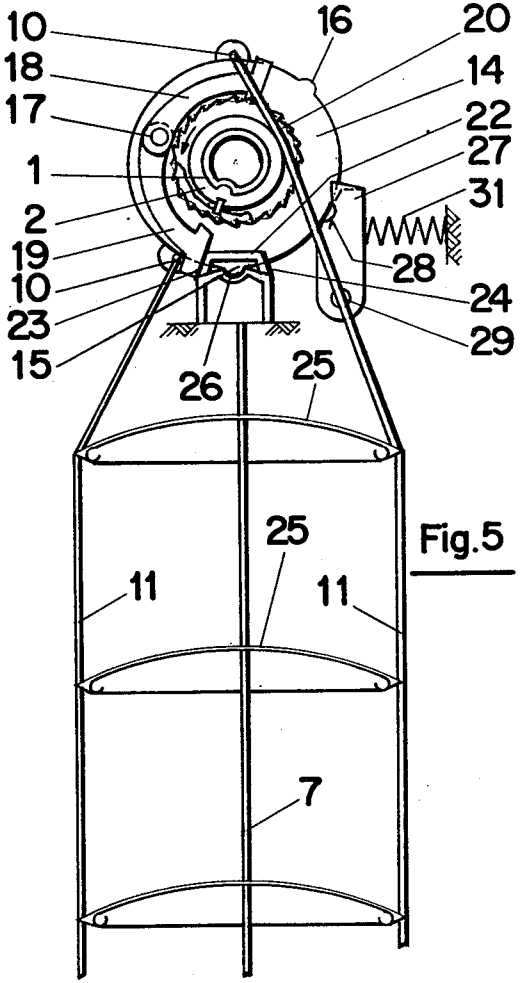
FIG. 5 is a fragmentary end elevational view of the venetian blind, with the slats shown in open positions.

The sleeve 2 further supports a second sleeve or carrier 12 which is mounted thereon opposite the cam 4 (i.e., the flanges 3 are located between the sleeve 12 and the cam 4) and can rotate relative to the shaft 1. The sleeve 12 has two parallel crossheads or beams 9 whose ends are secured to each other by pins 10 extending in parallelism with the axis of the shaft 1. The crossheads 9 can be said to constitute two arms which extend in opposite directions from the axis of the shaft 1. The sleeve 12 and its crossheads 9 form part of a turning mechanism which serves to change the angular positions of the slats 25. The pins 10 are connected with downwardly extending motion-transmitting flexible elements 11 (hereinafter called cords) which are further attached to the respective marginal portions of the slats 25 (see FIGS. 5 to 7). If one of the cords 11 moves upwardly while the other cord 11 moves downwardly, the slats 25 are tilted between the open, intermediate and closed positions which are respectively shown in FIGS. 5, 6 and 7. In FIG. 5, the planes of the slats 25 are substantially horizontal so that the venetian blind intercepts a very small percentage of incoming daylight. In FIG. 6, the planes of the slats 25 are slightly inclined with respect to a horizontal plane (however, the neighboring slats do not overlap each other) so that the blind intercepts a relatively small amount of incoming light. In FIG. 7, the lower marginal portions of upper slats 25 are located below the upper marginal portions of the slats therebelow, i.e., the slats overlap each other and intercept a major percentage of incoming light.

The second sleeve 12 is further rigid with the housing or casing 13 of a clutch. The casing 13 has a disk-shaped wall 14 which is located in a plane making a right angle with the axis of the shaft 1. The wall 14 is actually a cam which is provided with two relatively small peripheral projections or lobes 15 and 16 (see FIGS. 1 and 2). A relatively short shaft or pivot member 17 is mounted in the casing 13 in parallelism with the shaft 1 and carries two pivotable pawls 18 and 19. The pallets of the pawls 18, 19 can respectively engage the teeth of two ratchet wheels 20, 21 which are rigid with the sleeve 2 and are adjacent to the wall 14 of the casing 13. When the shaft 1 is rotated in one direction, the ratchet wheel 20 entrains the associated pawl 18 and causes the casing 13 to rotate the sleeve 12 with the crossheads 9 in one direction, i.e., the slats 25 are tilted in a first direction. If the shaft 1 is rotated in the opposite direction, the ratchet wheel 21 causes the associated pawl 19 to rotate in the same direction whereby the casing 13 causes the sleeve 12 to turn the crossheads 9 in the opposite direction, i.e., the slats 25 are tilted in a second direction.

The parts 1, 2, 3 and 7 constitute a means for moving the slats 25 up and down between upper and lower end positions in which the venetian blind is respectively fully contracted and fully extended. The parts 9, 10, 11 and 12 constitute the aforementioned turning mechanism which can change the angular positions of the slats 25 between first and second end positions (respectively shown in FIGS. 5 and 7) and through a practically infinite number of intermediate positions including that which is shown in FIG. 6.

A stop 22 which is fixedly mounted at a level below the sprocket wheels 20, 21 has two suitably inclined disengaging surfaces 23 and 24. When the shaft 1 is rotated in a counterclockwise direction, as viewed in FIG. 5, to raise the slats 25 (i.e., to reduce the length of the venetian blind), the ratchet wheel 21 engages and moves the pawl 19 until the latter reaches the disengaging surface 23. The surface 23 then disengages the pallet of the pawl 19 from the adjacent teeth of the ratchet wheel 21 at a time when the slats 25 are located in horizontal planes i.e., when the slats are open so that they intercept a minimal amount of incoming daylight. The stop 22 is connected with a deformable elastic retaining element 26 forming part of a detent which further includes the lobes 15 and 16 of the wall 14. The lobe 15 enters a notch of the retaining element 26 when the surface 23 disengages the pallet of the pawl 19 from the adjacent teeth of the ratchet wheel 21. Thus, the angular positions of the slats 25 remain unchanged during further shortening of the ventian blind.

If the shaft 1 is rotated in a clockwise direction, as viewed in FIG. 6, to lower the slats 25, the ratchet wheel 20 engages the pawl 18 and rotates the sleeve 12 and its crossheads 9 in a direction to change the angular positions of the slats 25. The means for maintaining the slats 25 in partly open or intermediate positions (FIG. 6) during lengthening of the venetian blind comprises an arresting member 27 having a recess or notch 28 for the lobe 16 of the wall 14. The arresting member 27 is pivotable with a shaft 29 which is parallel to the shaft 1, and the member 27 is biased toward the periphery of the wall 14 by a helical spring 31. The shaft 29 further carries a follower 30 which tracks the periphery of the cam 4. When the pawl 18 is engaged and arrested by the member 27, the lobe 16 of the wall 14 enters the notch 28 and remains in such notch under the action of the spring 31 so that the slats 25 remain in the partly open or intermediate positions of FIG. 6 during further lengthening of the blind. The parts 27, 30 are rigid with the shaft 29 which is turnable in suitable bearing means, not shown. The engagement between the pawl 18 and arresting member 27 is terminated when the length of the venetian blind is increased to a maximum value, i.e., when the strip 7 is unwound from the pulley including the flanges 3 and allows the spring 6 to move radially of an away from the shaft 1. The arrangement is preferably such that the spring 6 is free to move toward the recess 5 of the cam 4 shortly before the length of the venetian blind reaches its maximum value, e.g., when the shaft 1 must complete an additional angular movement through 180° to 270° in order to allow the lowermost slat 25 to assume a position at a maximum distance from the shaft 1 and sleeve 2. The cam 4 then rotates with the parts 1, 2 and the radially outermost portion 4*b* of its peripheral surface disengages the arresting member 27 from the pawl 18 in response to further clockwise rotation of the shaft 1. The means for pivoting the arresting member 27 clockwise from the operative position of FIG. 1 to the inoperative position of FIG. 2 includes the follower 30 (which tracks the periphery of the cam 4) and the shaft 29 which is rigid with the parts 30 and 27. The pallet of the pawl 18 then reengages the adjacent teeth of the associated ratchet wheel 20 and the latter is free to rotate the sleeve 12 and the crossheads 9 in a clockwise direction until the pawl 18 reaches the surface 24 of the stop 22 and is again disengaged from the ratchet wheel 20. At the same time, the lobe 16 of the wall 14 enters the notch of the retaining element 26 and releasably holds the sleeve 12 against further angular movement. This takes place when the slats 25 are closed (see FIG. 7).

If the slats 25 are to be raised, the shaft 1 is rotated in a counterclockwise direction (FIG. 5). The ratchet wheel 21 rotates the sleeve 12 by way of the pawl 19 and the sleeve 12 causes the crossheads 9 and cords 11 to pivot the slats 25 toward open positions. The pivoting of slats 25 is terminated when the pawl 19 reaches the surface 23 of the stop 22 and is disengaged from the ratchet wheel 21. The lobe 15 of the wall 14 enters the notch of the retaining element 26 and the slats 25 are then yieldably held in open positions. The slats 25 remain in such open positions during further shortening of the venetian blind as well as when the venetian blind remains in the fully raised position. During counterclockwise rotation of the shaft 1 for the purpose of reducing the length of the blind, the spring 6 continues to couple the cam 4 to the sleeve 2 during a certain angular displacement of the shaft 1; the strip 7 then depresses the spring 6 and allows the shaft 1 and its sleeve 2 to rotate relative to the cam 4 which is held against rotation by the follower 30. The latter bears against the peripheral surface of the cam 4 under the action of the spring 31. The angular movement of the cam 4 during the initial stage of counterclockwise rotation of the shaft 1 for the purpose of lifting the blind is desirable because the cam 4 allows the spring 31 to return the arresting member 27 to operative position, i.e., into the path of movement of the pawl 18.

The venetian blind further comprises blocking means, not shown, which prevents clockwise rotation of the shaft 1 during lowering of the slats 25 beyond the positions shown in FIG. 7 in which the slats 25 are closed. In other words, the shaft 1 cannot be rotated in a direction to wind the strip 7 onto the pulley including the flanges 3 in a direction counter to that in which the strip 7 is convoluted in FIG. 3. This insures that the slats 25 can be pivoted between fully open and fully closed positions only when the length of the venetian blind has been increased to the maximum possible value.

The sleeve 2 is mounted on the shaft 1 adjacent to one side of the window, and the shaft 1 carries at least one additional sleeve 2 with an additional cam 4, flanges 3, turning means 9, 10, 11, 12 and clutch means 13, 17–21.

If desired, the clutch means including the parts 13 and 17–21 can be replaced with a friction clutch (not shown) which can establish a torque-transmitting connection between the shaft 1 and turning means 9, 10, 11, 12. The thus modified venetian blind also comprises a stop and an arresting member (corresponding or analogous to stop 22 and member 27) which serve to limit the angular displacement of slats 25 in a manner as shown in FIGS. 5, 6 and 7.

Figure 8:
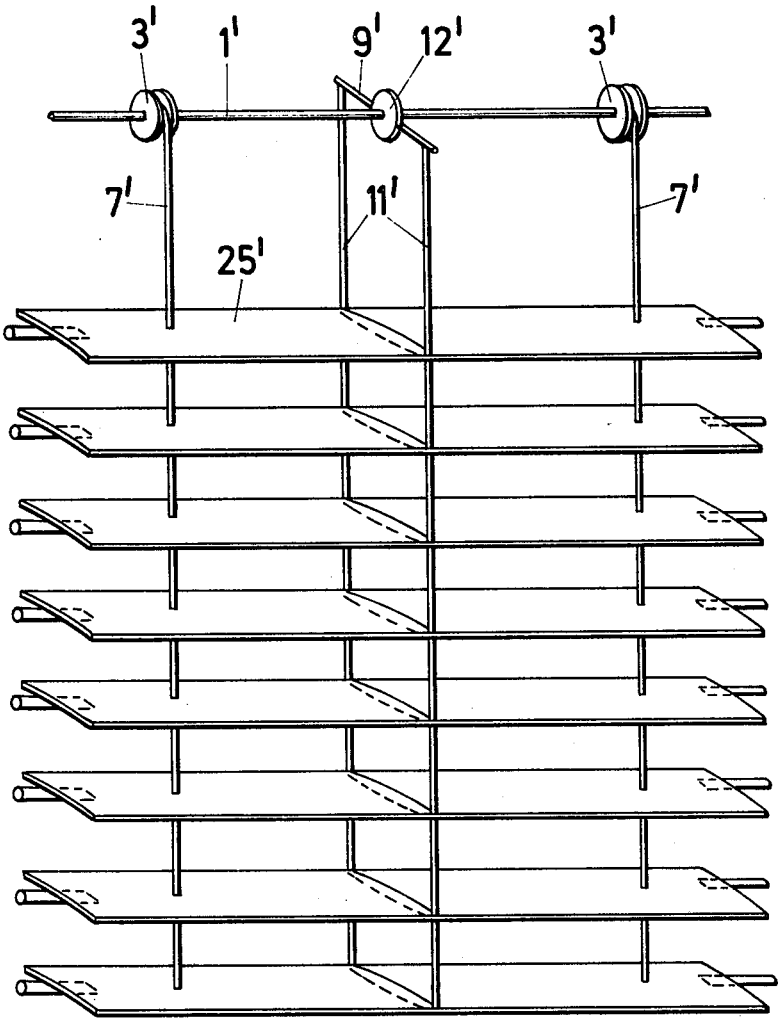
FIG. 8 is a schematic perspective view of a modified venetian blind.

FIG. 8 shows a slightly modified venetian blind wherein all such parts which are identical with or clearly analogous to corresponding parts of the venetian blind of FIGS. 1 to 7 are denoted by similar reference characters each followed by a prime. The end portions of the slats 25′ have outwardly extending studs or trunnions which are guided in vertical slots at the respective sides of the window or are mounted in suitable supporting parts, not shown. This is desirable because the slats 25′ are suspended on a single pair of cords 11′. The cords 11′ are attached to the crossheads 9′ of a carrier member 12′ corresponding to the sleeve 12 of FIGS. 1 to 7. These cords are disposed between the strips 7′ each of which can be convoluted onto a discrete pulley including two flanges 3′ which are rotatable with the shaft 1′. The lowermost slat 25′ may constitute or may be replaced by a customary rigid rail which is connected with the lower ends of the strips 7′ and cords 11′. Since the carrier member 12′ of the turning means for the slats 25′ is remote from both pulleys (flanges 3′), the sleeve which corresponds to the sleeve 2 of FIG. 1 and carries one of the pulleys must be long enough to be capable of carrying the sprocket wheels for the pawls which are rotatable with the carrier member 12′ and correspond to the pawls 18, 19 of FIG. 1. An advantage of the venetian blind of FIG. 8 is that it employs a single turning device (9′, 11′, 12′) for the slats 25′. The aforementioned supporting parts for the ends of slats 25′ are disclosed in British Pat. No. 161,407.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In a venetian blind, a combination comprising a plurality of substantially horizontal slats disposed one above the other; means for moving said slats upwardly and downwardly between upper and lower end positions; means for turning said slats between first and second end positions in which the neighboring slats respectively do not and do overlap each other and the blind is respectively open and closed; means for maintaining said slats at least close to said first end positions while said moving means is operated to move said slats upwardly so that, while moving upwardly, the neighboring slats do not overlap each other; and means for maintaining said slats in predetermined intermediate positions between said first and second end positions, in which intermediate positions the neighboring slats do not overlap each other, while said moving means is operated to move said slats downwardly.

2. A combination as defined in claim 1, wherein said turning means comprises at least one component which is located above the uppermost slat.

3. A combination as defined in claim 1, further comprising detent means for releasably holding said slats in at least one of said first and second end positions thereof.

4. A combination as defined in claim 1, further comprising detent means for releasably holding said slats in said intermediate positions thereof.

5. A combination as defined in claim 1, further comprising stop means for limiting the turning of said slats to an angular movement between said first and second end positions, said means for maintaining said slats in said intermediate positions comprising arresting means movable between operative and inoperative positions in which said arresting means respectively maintains said slats in said intermediate positions and allows the slats to turn between said first and second end positions, means for moving said arresting means to said operative position in response to operation of said first mentioned moving means in a direction to move said slats upwardly, and means for moving said arresting means to said inoperative position not later than when said slats reach said lower end positions so that the slats are turnable, at least to said second end positions, in said lower end positions thereof.

6. A combination as defined in claim 5, wherein said first mentioned moving means comprises a substantially horizontal shaft rotatable in first and second directions to thereby respectively effect movements of said slats toward said upper and lower end positions, said means for moving said arresting means to said inoperative position comprising cam means mounted on said shaft and follower means tracking said cam means and operatively connected with said arresting means.

7. A combination as defined in claim 6, wherein said cam means is normally rotatable relative to said shaft and further comprising means for establishing a torque-transmitting connection between said shaft and said cam means in the lower end positions of said slats.

8. A combination as defined in claim 1, wherein said moving means comprises a substantially horizontal shaft disposed above the uppermost slat and rotatable in first and second directions, at least one pulley mounted on and rotatable with said shaft, and a flexible member having a first end secured to said pulley and a second end secured to the lowermost slat so that said pulley respectively collects and pays out said flexible member when said shaft is respectively rotated in said first and second directions and the lowermost slat respectively moves upwardly toward said shaft and descends by gravity.

9. A combination as defined in claim 8, wherein said turning means comprises elongated flexible motion transmitting means connected with each of said slats and means for moving said motion transmitting means lengthwise, said last mentioned moving means being disposed above the uppermost slat.

10. A combination as defined in claim 9, wherein each of said slats has first and second substantially horizontal marginal portions and said motion transmitting means comprises first and second flexible elements respectively connected with the first and second marginal portions of said slats, said last mentioned moving means comprising a carrier mounted on said shaft and having first and second portions extending in the opposite directions from the axis of said shaft and respectively connected with said first and second flexible elements so that one of said flexible elements moves upwardly and the other of said flexible elements moves downwardly when said carrier is rotated in said first direction and vice versa, and means for rotating said carrier during predetermined stages of rotation of said shaft.

11. A combination as defined in claim 10, wherein said pulley includes a sleeve which forms part of said first mentioned moving means and of said means for rotating said carrier.

12. A combination as defined in claim 10, wherein said carrier is rotatable on said shaft and said means for rotating said carrier comprises first and second ratchet wheels driven by said shaft and first and second pawls mounted on said carrier and respectively engaging said first and second ratchet wheels when said shaft respectively rotates in said first and second directions, said means for maintaining said slats in said first and second end positions including stop means located in the path of movement of said pawls to disengage said first pawl from said first wheel once said slats assume said first end positions and to disengage said second pawl from said second wheel once said slats assume said second end positions, said means for maintaining said slats in said intermediate positions comprising arresting means located in the path of movement of said second pawl to disengage the latter from said second wheel while said shaft rotates in said second direction.

13. A combination as defined in claim 12, further comprising means for moving said arresting means away from the path of said second pawl not later than when said slats reach said lower end positions.

* * * * *